US007538290B2

(12) United States Patent
Nakade et al.

(10) Patent No.: US 7,538,290 B2
(45) Date of Patent: May 26, 2009

(54) AUTOMOTIVE PUSH SWITCH

(75) Inventors: Yoshiyuki Nakade, Fukui (JP); Hiroyuki Kosaka, Fukui (JP)

(73) Assignee: Panasonic Corporation, Osaka (JP)

( * ) Notice: Subject to any disclaimer, the term of this patent is extended or adjusted under 35 U.S.C. 154(b) by 58 days.

(21) Appl. No.: 11/706,337

(22) Filed: Feb. 15, 2007

(65) Prior Publication Data

US 2007/0199813 A1 Aug. 30, 2007

(30) Foreign Application Priority Data

Feb. 28, 2006 (JP) ..... 2006-051712

(51) Int. Cl.
*H01H 13/14* (2006.01)

(52) U.S. Cl. ..... 200/520; 200/537; 200/344; 200/529; 341/22; 400/480

(58) Field of Classification Search ..... 200/520, 200/16 B, 530, 537, 341, 344, 239, 524, 529; 341/22, 34; 400/480, 481, 490

See application file for complete search history.

(56) References Cited

U.S. PATENT DOCUMENTS

| | | | | |
|---|---|---|---|---|
| 5,406,277 | A * | 4/1995 | Lee | 341/22 |
| 6,605,792 | B2 * | 8/2003 | Sato | 200/524 |
| 6,670,566 | B1 * | 12/2003 | Wang | 200/406 |
| 6,747,225 | B1 * | 6/2004 | Yu | 200/334 |
| 6,900,406 | B2 * | 5/2005 | Huber | 200/566 |
| 7,180,025 | B2 * | 2/2007 | Kuwana et al. | 200/520 |
| 7,446,269 | B2 * | 11/2008 | Stringos | 200/16 B |

FOREIGN PATENT DOCUMENTS

JP 2004-47122 A 2/2004

* cited by examiner

*Primary Examiner*—Kyung Lee
(74) *Attorney, Agent, or Firm*—McDermott Will & Emery LLP

(57) ABSTRACT

A groove-like recess, substantially V-shaped, extending vertically is formed on the outer circumference of an operation shaft, and a projection engaging the recess is provided on a guide hole, namely the inner circumference of a hollow pipe. Such makeup provides an automotive push switch that reduces an impactive force caused when the recess hits the projection within the movable range of the operation shaft, by decomposing or dispersing the force according to the inclination angle of the slope, and so does the hitting sound.

4 Claims, 11 Drawing Sheets

AUTOMOTIVE PUSH SWITCH

BACKGROUND OF THE INVENTION

1. Field of the Invention

The present invention relates to an automotive push switch mainly used for lighting control of a stop lamp in operation of a brake pedal of an automobile.

2. Background Art

In recent years, pressing-type automotive push switches have been widely used for controlling a stop lamp, which is turned on when a brake pedal is depressed; turned off when released.

Such a conventional automotive push switch is described using FIGS. 8 through 11.

FIG. 8 is a perspective view of a conventional automotive push switch. FIG. 9 is a sectional view of the same. In FIGS. 8, 9, lower case 1 is open-topped, substantially boxy, and made of insulating resin. Actuator 2 is made of insulating resin. Lower case 1 has multiple fixed contacts 3 with their terminals 3A projecting from the bottom surface thereof, implanted therein. The top of actuator 2 has column-shaped operating shaft 2A extending upward.

Movable contact 4 is made of conductive metal. This movable contact 4 elastically contacts multiple fixed contacts 3 on their bottoms by means of contact spring 5 attached between movable contact 4 and the bottom surface of case 1 in a slightly compressed state. Then, multiple fixed contacts 3 are electrically connected to each other through movable contact 4 to form switch contact 6.

Return spring 7 is coiled. Upper case 8 covers the opening at the top of lower case 1. Return spring 7, attached between the undersurface of actuator 2 and the bottom surface of lower case 1 in a slightly compressed state, impresses thrusting force on actuator 2 upward.

Upper case 8 is provided with hollow pipe 8B projecting upward. Then, circular guide hole 8A vertically penetrates inside hollow pipe 8B. This guide hole 8A contains operating shaft 2A of actuator 2 inserted thereinto movably up and down. The top end of operating shaft 2A projects upward from hollow pipe 8B, and actuator 2 is housed in upper case 8 to compose automotive push switch 9. Here, a given gap is provided between the outer circumference of operating shaft 2A and guide hole 8A so that operating shaft 2A smoothly moves up and down.

FIG. 10 is an external view of a braking device using a conventional automotive push switch.

As shown in FIG. 10, conventional automotive push switch 9 is generally attached in front of brake pedal 10 of an automobile, and terminal 3A of fixed contact 3 has connector 11 connected to a stop lamp (not shown) attached thereto.

With brake pedal 10 not being depressed, arm 10A of brake pedal 10, biased counterclockwise, namely in the right direction, presses operating shaft 2A, resulting in actuator 2 moved downward in upper case 8. Multiple fixed contacts 3 separate from movable contact 4, causing fixed contacts 3 to be electrically disconnected from movable contact 4, and thus the stop lamp is off.

FIGS. 11A, 11B are sectional views of a conventional automotive push switch in operation.

In FIG. 11A, arm 10A obliquely touches the distal end of operating shaft 2A to press operating shaft 2A, and thus operating shaft 2A is pressed and retained with its distal end tilted upward and its outer circumference touching the surface of guide hole 8A.

Next, as shown in FIG. 10, with brake pedal 10 depressed, arm 10A rotates clockwise, namely in the left direction, centering on axis 10B, separating arm 10A from operating shaft 2A to remove the pressing force. Then, actuator 2 impressed by return spring 7 moves outward (refer to FIG. 11B). At this moment, as shown in FIG. 9, press contact spring 5 causes movable contact 4 to elastically contact multiple fixed contacts 3, which then connects fixed contacts 3 to each other to turn on the stop lamp.

As a prior art document related to the invention of this patent application, Japanese Patent Unexamined Publication No. 2004-47122 is known, for example.

In this way, with brake pedal 10 not being depressed, operating shaft 2A, the distal end of which is tilted obliquely upward, is biased downward in process of the rotation of arm 10A, owing to the tilt of arm 10A touching the distal end of operating shaft 2A and the thrusting force of return spring 7, according to arm 10A rotating in the left direction. However, operating shaft 2A swings momentarily between operating shaft 2A and guide hole 8A to hit the surface of guide hole 8A downward roughly vertically, thus causing a hitting sound due to the impactive force.

SUMMARY OF THE INVENTION

The present invention provides an automotive push switch silent with soft operation sound.

The present invention is an automotive push switch in which a recess is formed on any one of the outer circumference of the operation shaft and the inner circumference of the hollow pipe, and a projection engaging the recess is provided on the rest of these circumferences. For example, the outer circumference of the operation shaft has a groove-like recess with its cross section substantially V-shaped, formed thereon, and a guide hole, namely the inner circumference of the hollow pipe, has a substantially arc-shaped projection engaging the recess, provided thereon. With such makeup, when the slope of the recess on the outer circumference of operation shaft hits and touches the projection on the guide hole by depression of the brake pedal, the impactive force is reduced by being decomposed or dispersed according to the inclination angle of the slope, thus reducing the hitting sound.

As described above, the present invention allows implementing an automotive push switch silent with soft operation sound.

DETAILED DESCRIPTION OF PREFERRED EMBODIMENT

A description is made for an embodiment of the present invention, using FIGS. 1 through 7.

Exemplary Embodiment

Figure 1:
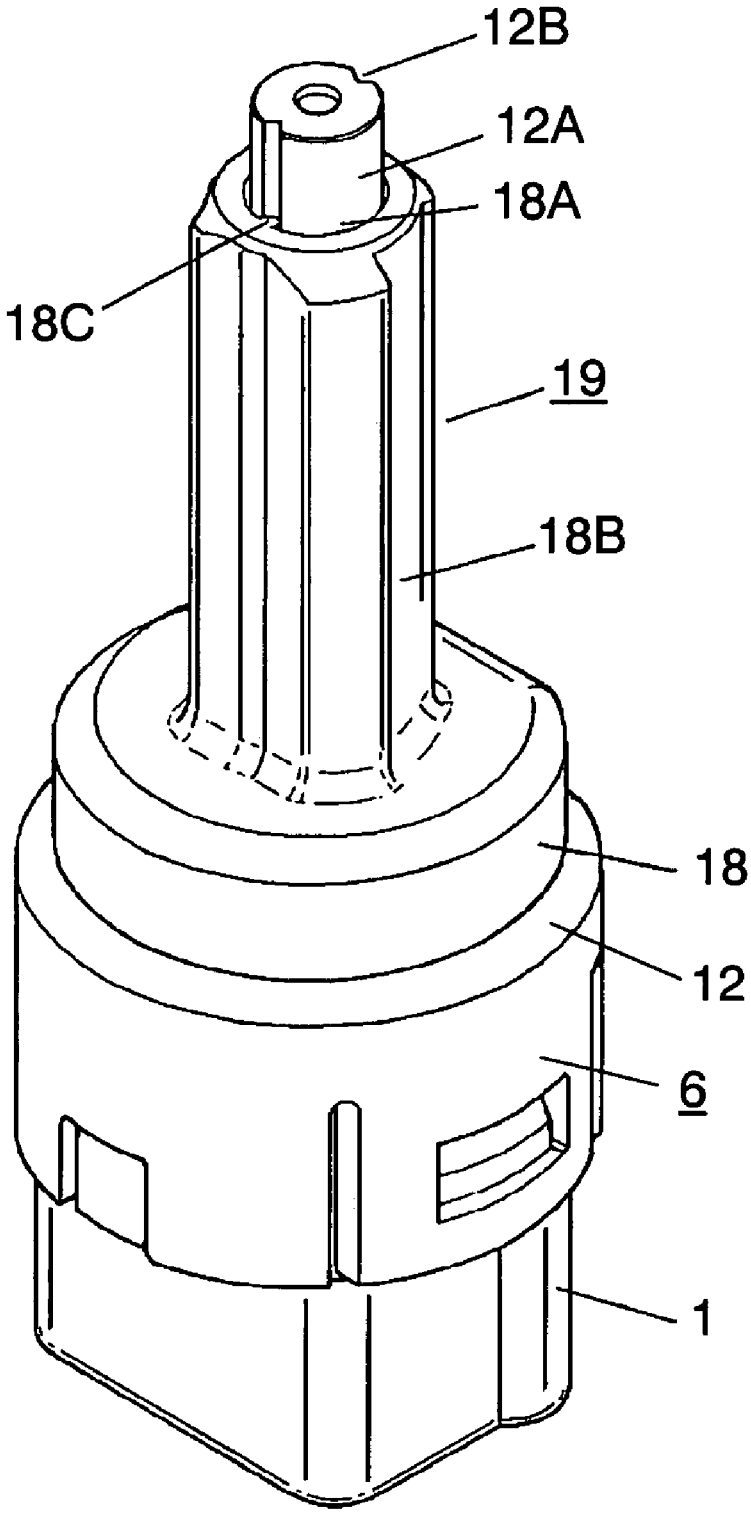
FIG. 1 is a perspective view of an automotive push switch according to an exemplary embodiment of the present invention.
Figure 2:
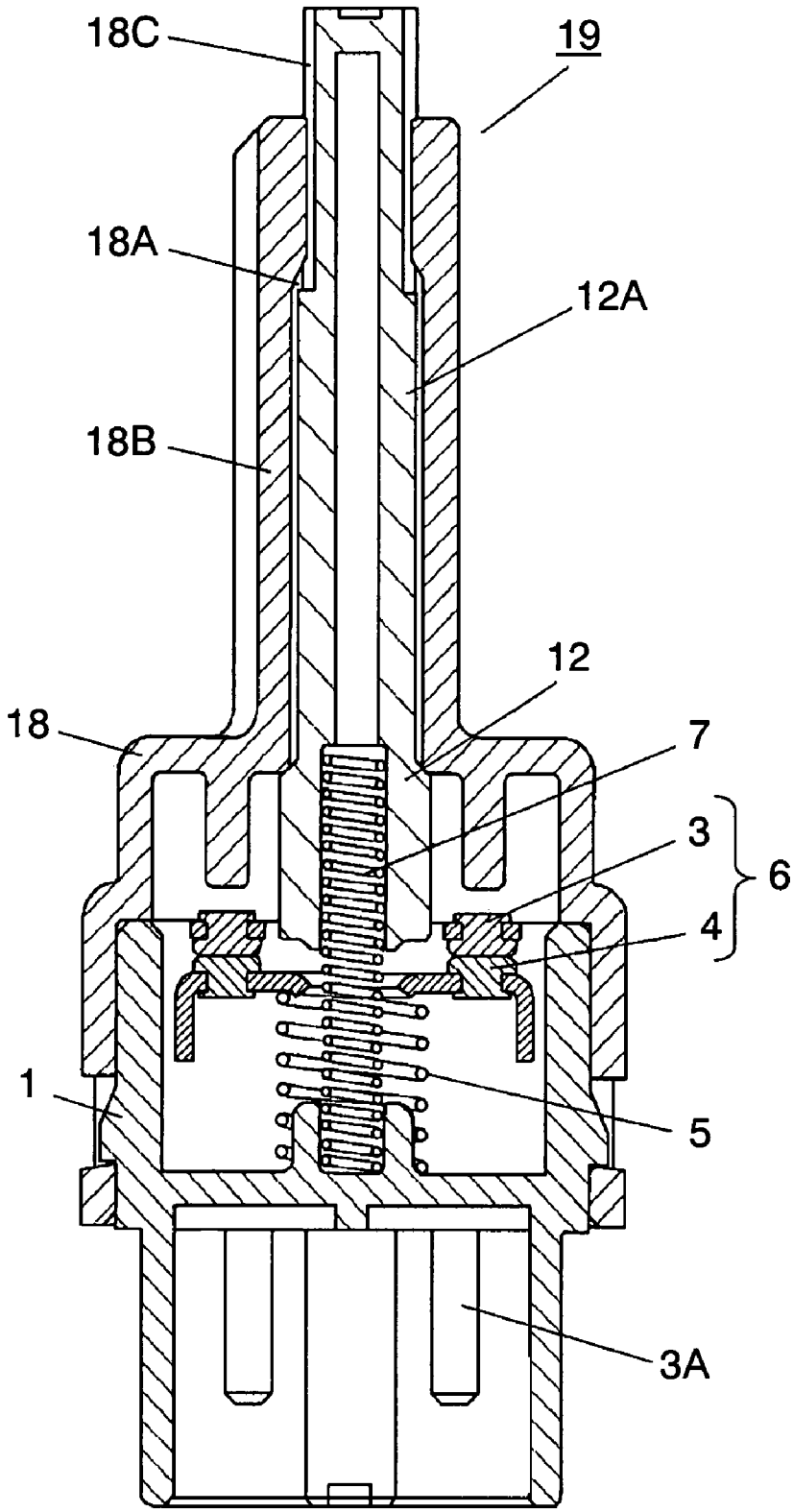
FIG. 2 is a sectional view of the same.
Figure 3:
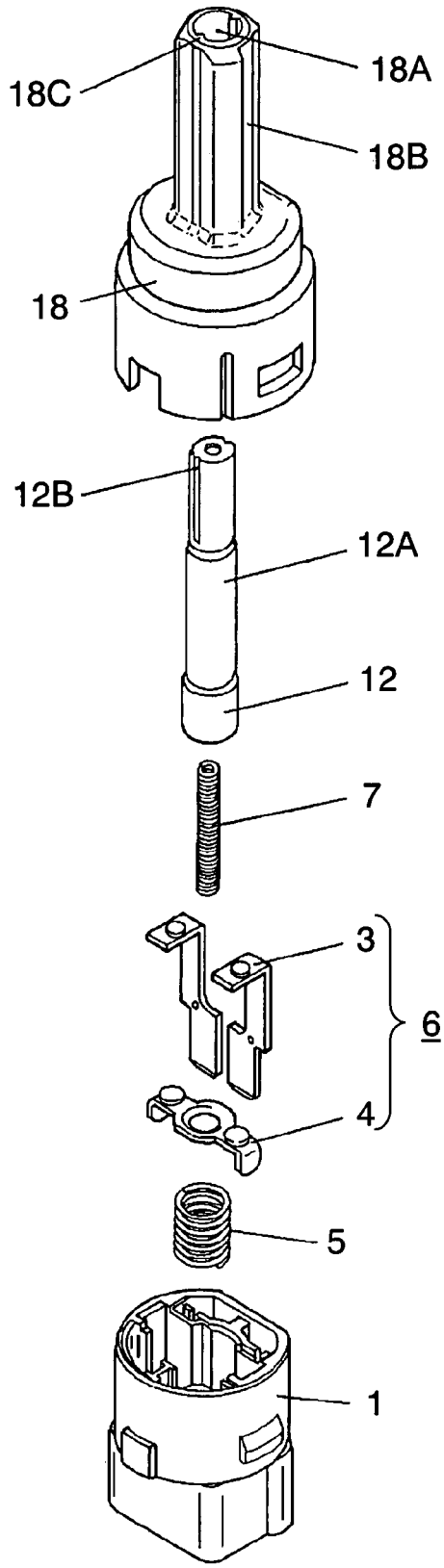
FIG. 3 is an exploded perspective view of the same.

FIG. 1 is a perspective view of an automotive push switch according to an exemplary embodiment of the present invention; FIG. 2 is a sectional view of the same; FIG. 3 is an exploded perspective view of the same. In FIGS. 1, 2, 3, lower case 1 is substantially boxy, open-topped, and is made of insulating resin such as polybutylene terephthalate (described as PBT hereinafter) or polyphenylene sulfide (described as PPS hereinafter). Lower case 1 has multiple fixed contacts 3 with their terminals 3A projecting from the bottom surface thereof, implanted therein.

Movable contact 4 is formed with conductive metal. This movable contact 4 elastically contacts multiple fixed contacts 3 on their bottoms by means of contact spring 5 attached between movable contact 4 and the bottom surface of case 1 in a slightly compressed state. Then, multiple fixed contacts 3 are electrically connected to each other through movable contact 4 to form switch contact 6.

Actuator 12, made of insulating resin such as PBT or PPS, has substantially column-shaped operation shaft 12A formed on a top thereof.

Return spring 7 is coiled. Upper case 18, made of insulating resin such as PBT or PPS, covers the opening at the top of lower case 1. Return spring 7, attached between the undersurface of actuator 2 and the bottom surface lower case 1 in a slightly compressed state, impresses thrusting force on actuator 2 upward.

Upper case 18 is provided with hollow pipe 18B projecting upward, with substantially circular guide hole 18A penetrating inwardly. This guide hole 18A has substantially column-shaped operation shaft 12A of actuator 12, inserting thereinto movably up and down, where the distal end of operation shaft 12A projects upward from hollow pipe 18B.

Guide hole 18A has substantially arc-shaped projections 18C formed projecting symmetrically about the central axis, both vertically extending by a given length. The outer circumference of operation shaft 12A has groove-like recess 12B with its cross section substantially V-shaped, formed by two slopes, flat or curved, facing and engaging these projections 18C, extending downward from the distal end.

While operation shaft 12A is positioned on the central axis same as that of guide hole 18A, a given gap is provided between projection 18C and recess 12B. The given gap restricts the diameterwise movable range of operation shaft 12A. Projection 18C touches only slope 12C of recess 12B within the movable range. In order to always ensure a gap between the surface of guide hole 18A, except for projection 18C, and the outer surface of operation shaft 12A, except for recess 12B, setting is made for the diameter of operation shaft 12A, shape of recess 12B, diameter of guide hole 18A, and shape of projection 18C.

Figure 4:
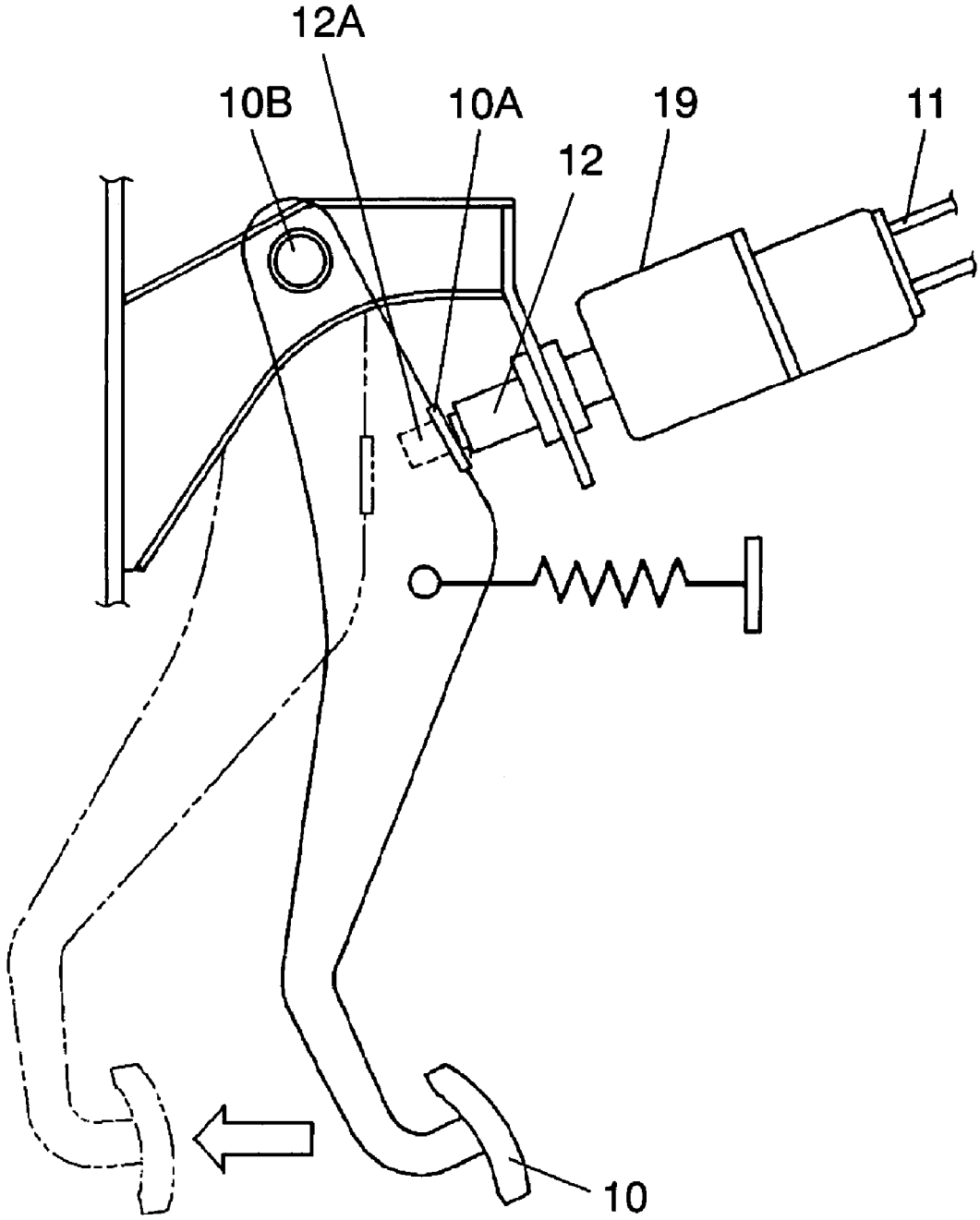
FIG. 4 is an external view of a braking device using the automotive push switch according to an exemplary embodiment of the present invention.

FIG. 4 is an external view of a braking device using the automotive push switch according to an exemplary embodiment of the present invention. In FIG. 4, automotive push switch 19 is generally attached in front of brake pedal 10 of an automobile, and connector 11 connected to a stop lamp (not shown) is attached to terminal 3A of fixed contact 3.

With brake pedal 10 not being depressed, arm 10A of brake pedal 10, biased counterclockwise, namely in the right direction, presses operating shaft 12A of actuator 12, resulting in actuator 12 moved downward in upper case 18. Multiple fixed contacts 3 separate from movable contact 4, causing fixed contacts 3 to be electrically disconnected from movable contact 4, and thus the stop lamp is off. At this moment, arm 10A tilted obliquely downward right presses the distal end of operation shaft 12A, and thus operation shaft 12A is pressed and retained with its distal end tilted upward in guide hole 18A.

Next, when brake pedal 10 is depressed, arm 10A rotates centering on axis 10B clockwise, namely in the left direction, separating arm 10A from the distal end of operating shaft 12A to remove the pressing force on operating shaft 12A. Consequently, actuator 12 impressed by return spring 7 moves outward. Then, press contact spring 5 causes movable contact 4 to be elastically contacting multiple fixed contacts 3, as shown in FIG. 2, which then connects fixed contacts 3 to each other to turn on the stop lamp.

Figure 5A:
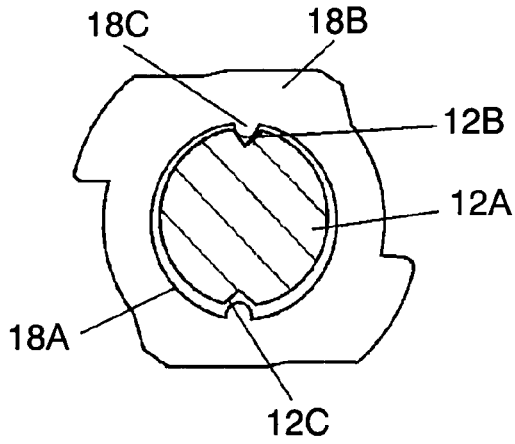
FIG. 5A is a partial sectional view of the same in operation.
Figure 5B:
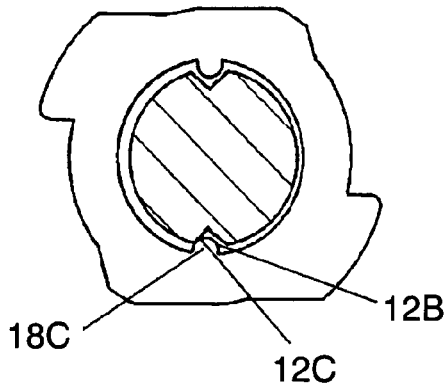
FIG. 5B is a partial sectional view of the same in operation.
Figure 5C:
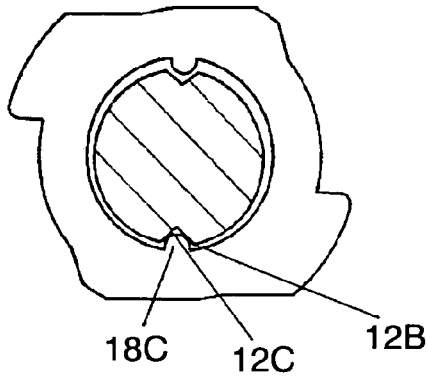
FIG. 5C is a partial sectional view of the same in operation.

FIGS. 5A, 5B, 5C are partial sectional views of the automotive push switch according to an exemplary embodiment of the present invention, in operation. In FIGS. 5A, 5B, 5C, conditions of operation shaft 12A with guide hole 18A change depending on a touching state of arm 10A with the distal end of operation shaft 12A, following arm 10A rotating clockwise.

First, when brake pedal 10 is not being depressed, operation shaft 12A pressed by arm 10A is tilted upward as shown in FIG. 5A. Then, operation shaft 12A with the bottom end of actuator 12 impressed by return spring 7, while recess 12B of operation shaft 12A touches projection 18C above guide hole 18A, is swung downward according to arm 10A rotating in the left direction, as shown in FIG. 5B, and slope 12C at the left side of recess 12B downward hits projection 18C.

However, an impactive force caused by slope 12C of recess 12B and projection 18C at this moment is reduced by being decomposed according to the inclination angle of slope 12C when slope 12C hits projection 18C, compared to the case where the outer circumference of conventional operating shaft 2A hits the inner circumference of conventional guide hole 8A roughly vertically, as described in Background Art, thus reducing the hitting sound as well.

In addition, when operation shaft 12A moves downward after that, operation shaft 12A moves down along slope 12C on projection 18C as shown in FIG. 5C, two positions of the distal end of projection 18C touch both slopes 12C of recess 12B to stop.

Figure 6A:
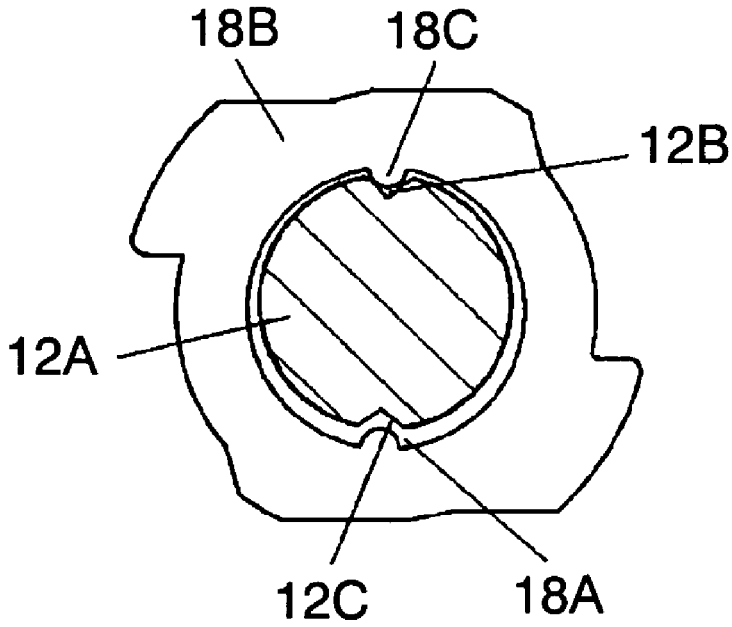
FIG. 6A is a partial sectional view of the same in operation.
Figure 6B:
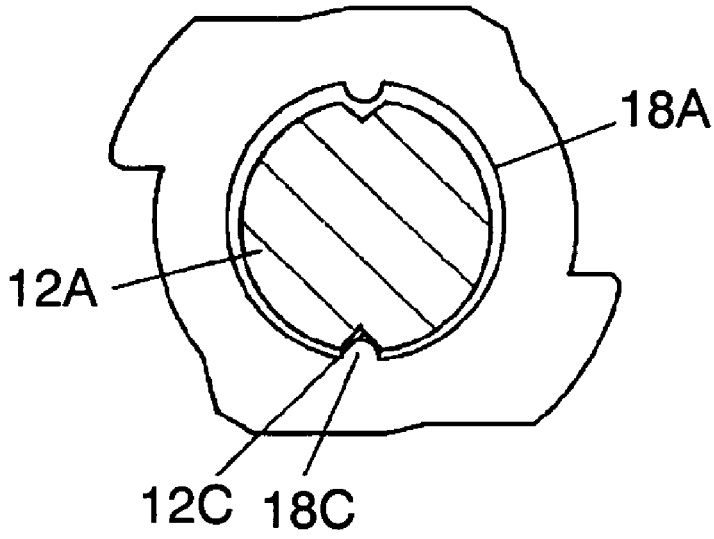
FIG. 6B is a partial sectional view of the same in operation.

FIGS. 6A, 6B are partial sectional views of the automotive push switch according to an exemplary embodiment of the present invention, in operation.

As shown in the partial sectional view of FIG. 6A, recess 12B of operation shaft 12A touches projection 18C above guide hole 18A. When brake pedal 10 is depressed, operation shaft 12A swings downward according to rotation of arm 10A, which is another operation state of operation shaft 12A in guide hole 18A, as shown in FIG. 6B. This causes two slopes 12C downward to hit projection 18C simultaneously. An impactive force caused by operation shaft 12A is dispersed to two slopes 12C, thus reducing a hitting sound caused by operation shaft 12A with guide hole 18A as well.

Figure 7A:
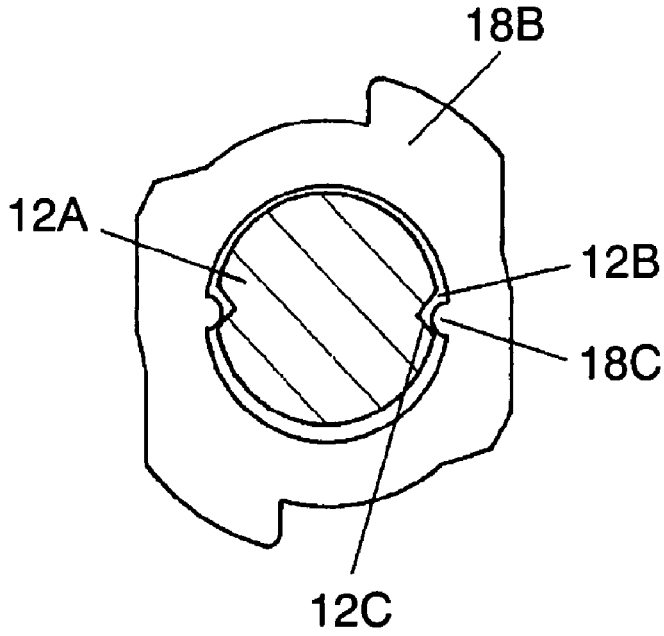
FIG. 7A is a partial sectional view of the same in operation.
Figure 7B:
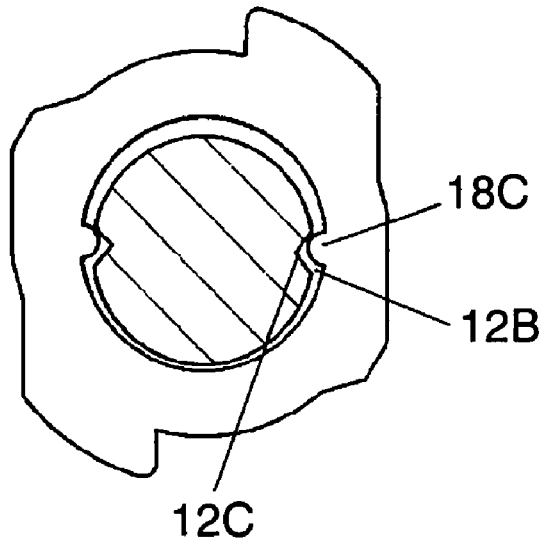
FIG. 7B is a partial sectional view of the same in operation.
Figure 8:
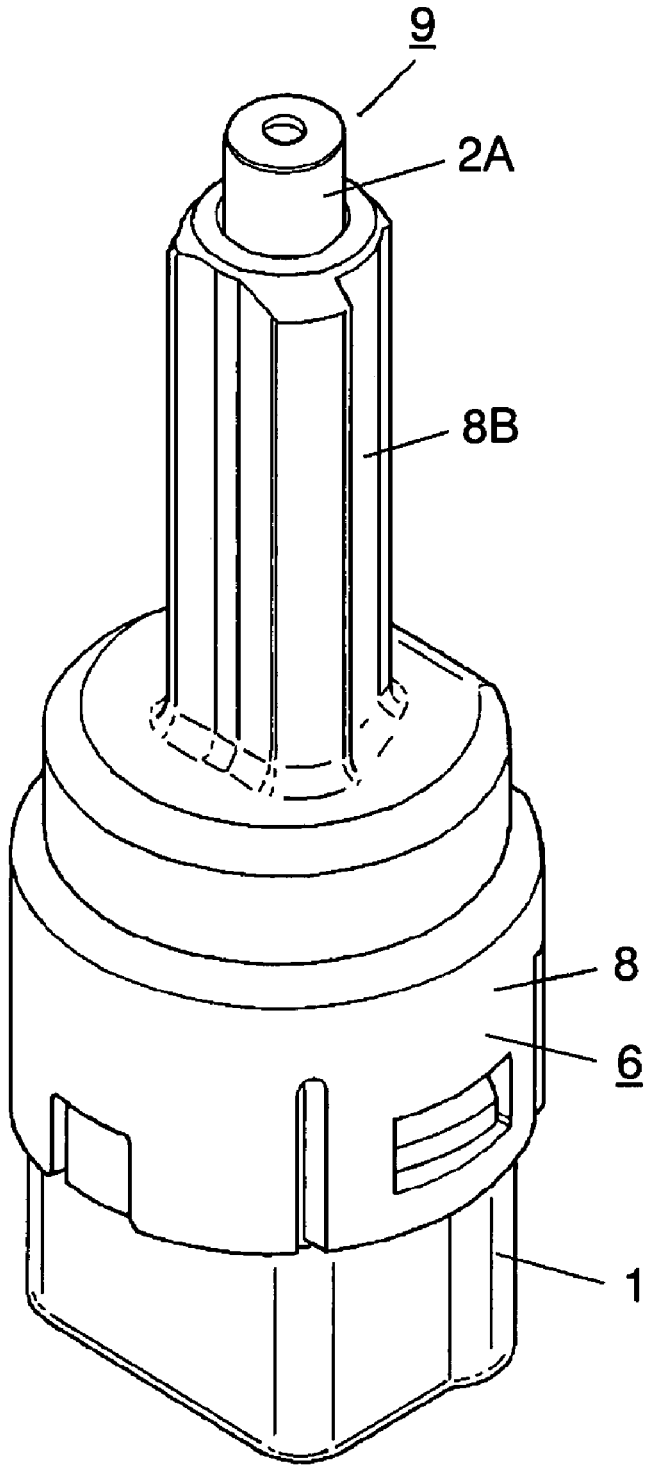
FIG. 8 PRIOR ART
FIG. 8 is a perspective view of a conventional automotive push switch.
Figure 9:
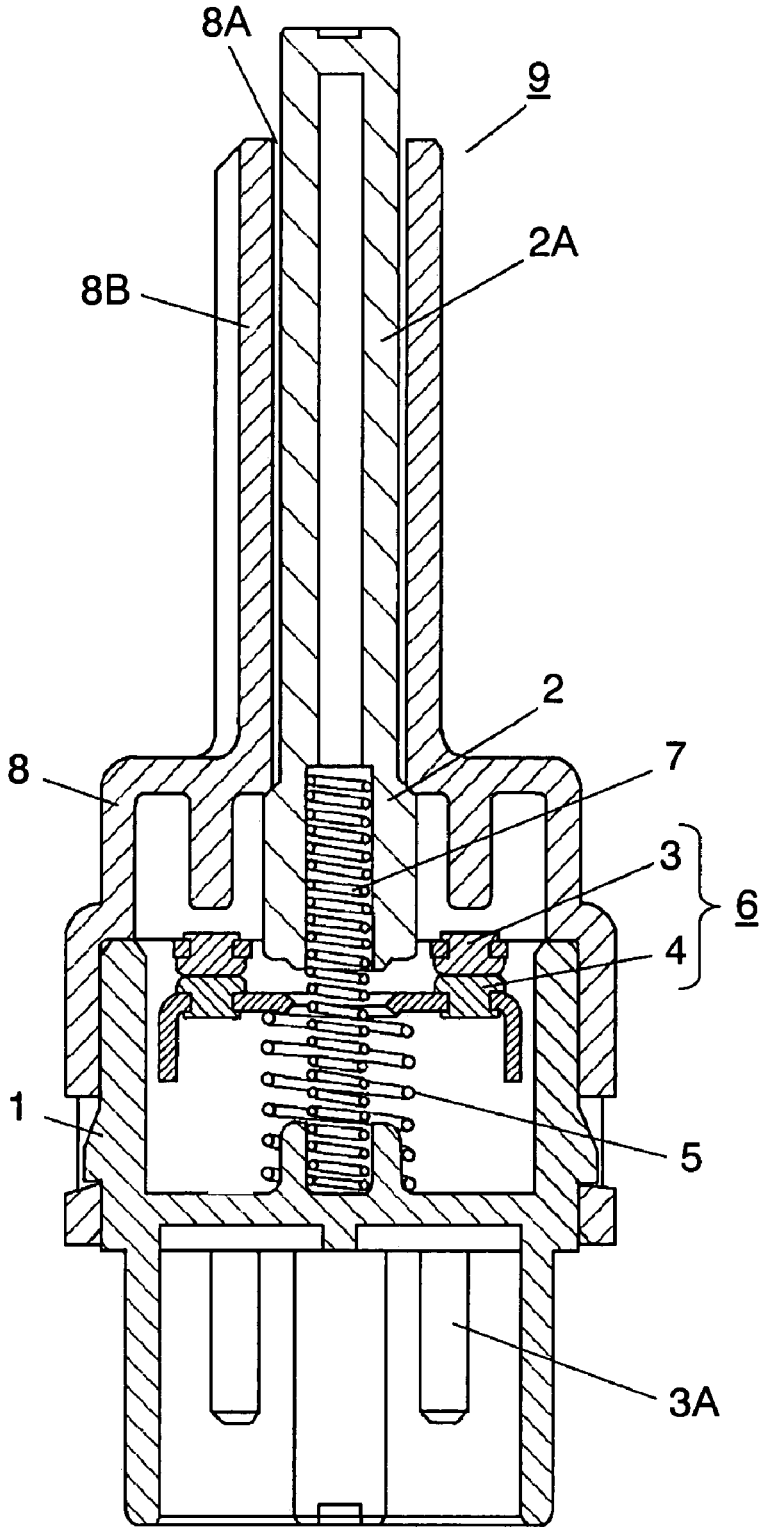
FIG. 9 PRIOR ART
FIG. 9 is a sectional view of the same.
Figure 10:
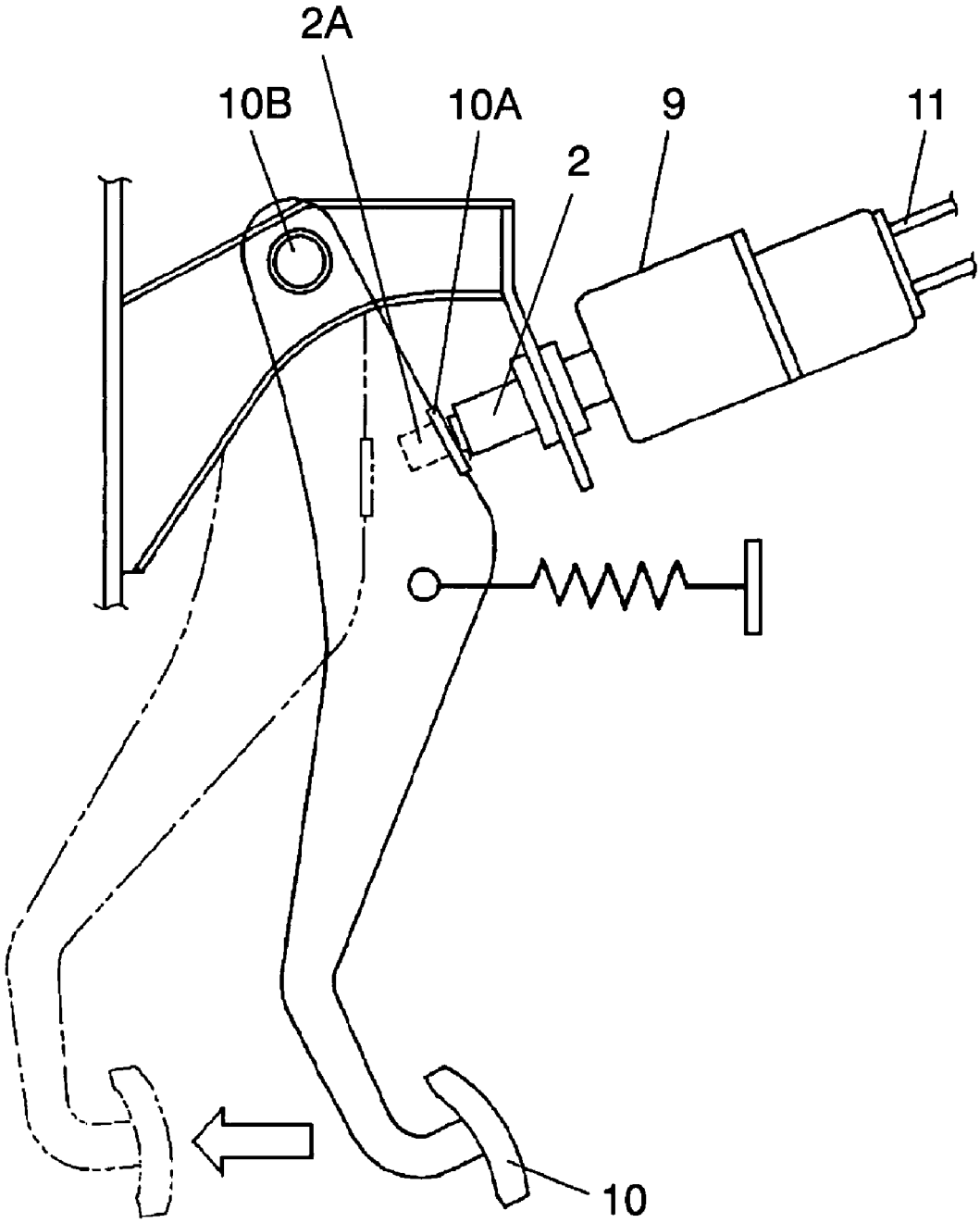
FIG. 10 PRIOR ART
FIG. 10 is an external view of a braking device using the conventional automotive push switch.
Figure 11A:
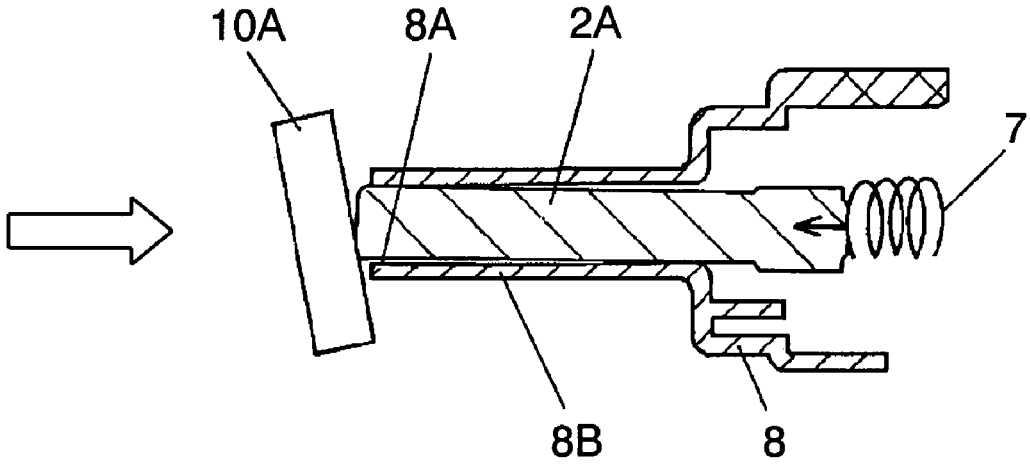
FIG. 11A PRIOR ART
FIG. 11A is a sectional view of the same in operation.
Figure 11B:
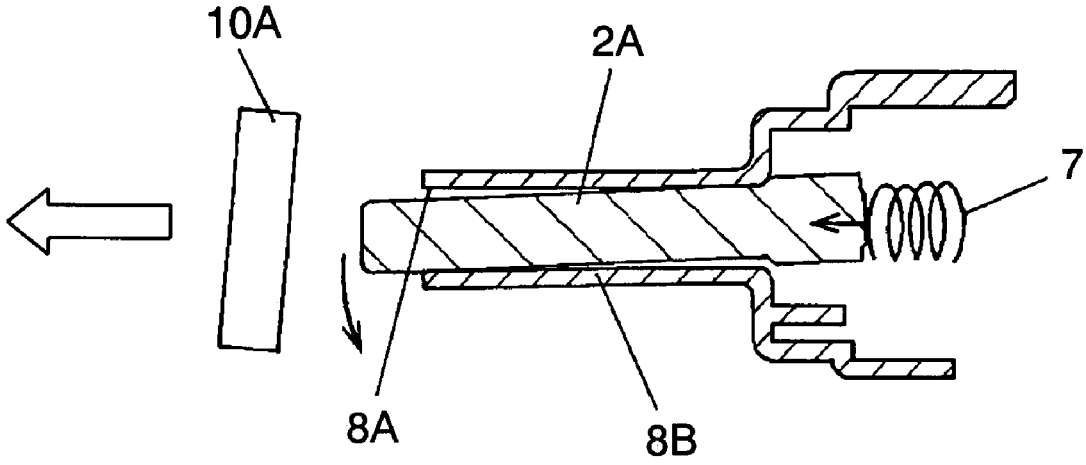
FIG. 11B PRIOR ART
FIG. 11B is a sectional view of the same in operation.

FIGS. 7A, 7B are partial sectional views of the automotive push switch according to an exemplary embodiment of the present invention, in operation. In FIGS. 7A, 7B, recess 12B of operation shaft 12A and projection 18C of guide hole 18A are attached to a vehicle with an angular separation of 90 degrees compared to the above described state.

First, while shaft 12A is being pressed by arm 10A, operation shaft 12A tilts upward, resulting in each bottom of projections 18C corresponding to slope 12C below recess 12B at the right and left touching slope 12C, as shown in FIG. 7A.

When brake pedal 10 is depressed, operation shaft 12A swings downward according to rotation of arm 10A, and two slopes 12C above recess 12B simultaneously hit the top of each projection 18C of guide hole 18A, as shown in FIG. 7B. However, an impactive force caused by operation shaft 12A is reduced by being dispersed to two slopes 12C, and so is a hitting sound.

In this way, when operation shaft 12A swings in guide hole 18A to touch the surface of guide hole 18A, slope 12C of recess 12B on operation shaft 12A obliquely touches projection 18C of guide hole 18A, or touches at two positions simultaneously. Consequently, an impactive force caused by operation shaft 12A when hitting is reduced by being decomposed or dispersed to multiple components according to the angle of slope 12C, and so is a resulting hitting sound.

As described above, in this embodiment, groove-like recess 12B is formed vertically extending on the outer circumference of operation shaft 12A, with its cross section substantially V-shaped, and projection 18C engaging recess 12B is provided in guide hole 18A, namely the inner circumference of hollow pipe 18B. Consequently, even if operation shaft 12A swings in guide hole 18A according to the operation of brake pedal 10, recess 12B always touches projection 18C, thus reducing an impactive force caused by operation shaft 12A with guide hole 18A. Accordingly, a hitting sound caused by operation shaft 12A with hollow pipe 18B is reduced as well, thus implementing an automotive push switch silent with soft operation sound.

In this embodiment, automotive push switch 19 is constructed by forming groove-like recess 12B, substantially V-shaped, on operation shaft 12A, and by forming projection 18C on guide hole 18A of hollow pipe 18B, respectively. However, the same effect is available even if a projection is formed on the outer circumference of operation shaft 12A, and a recess engaging the projection of operation shaft 12A is formed in guide hole 18A of hollow pipe 18B, respectively.

Moreover, the following makeup may be used. That is, recess 12B is provided in any one of the outer circumference of operation shaft 12A and guide hole 18A, and projection 18C is provided on the rest of them, so as to restrict the diameterwise movable range of operation shaft 12A between recess 12B and projection 18C. Such makeup allows the gap between recess 12B and projection 18C to be easily adjusted for a small and correct one, only by controlling the dimensions of limited positions of recess 12B and projection 18C, while roughly controlling the dimensions of the entire outer circumference of operation shaft 12A and the entire guide hole 18A. This makeup thus facilitates the production and dimensional maintenance and control of an automotive push switch of the present invention.

In this embodiment, two projections 18C are formed on guide hole 18A, facing two recesses 12B, substantially symmetrically about the diameter of operation shaft 12A. However, if a hitting sound caused by operation shaft 12A is loud only in one direction, recess 12B and projection 18C may be provided one each facing each other in a given direction.

Further, recesses 12B and projections 18C may be provided on the outer circumference of operation shaft 12A and the inner circumference of hollow pipe 18B, at three or more positions, facing each other. This makeup allows implementing an automotive push switch with soft operation sound owing to further softer hitting sound even for varied directions of tilt of operation shaft 12A in guide hole 18A.

An automotive push switch according to the present invention offers an advantage in that its operation sound is soft, useful mainly for an automotive push switch used for lighting control of a stop lamp in operation of a brake pedal.

What is claimed is:

1. An automotive push switch comprising:
a substantially box-like case;
a hollow pipe projecting upward from the case;
an actuator with an operation shaft thereof inserted into the hollow pipe movably up and down; and
a switch contact electrically connecting and disconnecting according to vertical movement of the actuator, wherein
the actuator is biased upward by a spring contained in the case, and wherein
a recess is formed on an outer circumference of an upper portion of the operation shaft that is disposed away from the case, and a projection engaging the recess is provided on an inner circumference of an upper portion of the hollow pipe that is disposed away from the case;
the hollow pipe comprises an upper portion disposed away from the case and a lower portion disposed between the case and the upper portion of the hollow pipe;
the operation shaft comprises a middle portion disposed downward from the upper portion of the operation shaft;
the projection does not extend to the lower portion of the hollow pipe; and
the recess does not extend to the middle portion of the operation shaft.

2. The automotive push switch according to claim 1, wherein:
the projection is column-shaped; and
the recess is V-shaped.

3. An automotive push switch comprising:
a substantially box-like case;
a hollow pipe projecting upward from the case;
an actuator with an operation shaft thereof inserted into the hollow pipe movably up and down; and
a switch contact electrically connecting and disconnecting according to vertical movement of the actuator, wherein
the actuator is biased upward by a spring contained in the case, and wherein
a recess is formed on an inner circumference of an upper portion of the hollow pipe that is disposed away from the case, and a projection engaging the recess is provided on an outer circumference of an upper portion of the operation shaft that is disposed away from the case;
the hollow pipe comprises an upper portion disposed away from the case and a lower portion disposed between the case and the upper portion of the hollow pipe;
the operation shaft comprises a middle portion disposed downward from the upper portion of the operation shaft;
the recess does not extend to the lower portion of the hollow pipe; and
the projection does not extend to the middle portion of the operation shaft.

4. The automotive push switch according to claim 3, wherein:
the projection is column-shaped; and
the recess is V-shaped.

* * * * *